US005131149A

United States Patent [19]

Thompson et al.

[11] Patent Number: 5,131,149

[45] Date of Patent: Jul. 21, 1992

[54] FOLDING KNIFE

[75] Inventors: Lynn C. Thompson, 2747 Seahorse, Ventura, Calif. 93001; Denis Lemaire, Boucherville, Canada

[73] Assignee: Lynn C. Thompson, Ventura, Calif.

[21] Appl. No.: 717,902

[22] Filed: Jun. 19, 1991

[51] Int. Cl.[5] ..... B26B 3/06

[52] U.S. Cl. ..... 30/161; 30/162; 30/331; 30/335

[58] Field of Search ..... 30/162, 153, 155, 158, 30/159, 160, 335, 330, 154, 161

[56] References Cited

U.S. PATENT DOCUMENTS

| | | | |
|---|---|---|---|
| 426,959 | 4/1890 | Reichardt | 30/161 |
| 2,774,139 | 12/1956 | Polk | 30/161 |
| 3,518,758 | 7/1970 | Bennett | 30/154 |
| 3,872,591 | 3/1975 | Quenot | 30/162 |
| 3,879,847 | 4/1975 | Roll | 30/162 |
| 4,356,631 | 11/1982 | Guth | 30/154 |
| 4,451,982 | 6/1984 | Collins | 30/161 |
| 4,719,700 | 1/1988 | Taylor, Jr. | 30/160 |
| 4,858,320 | 8/1989 | Lemaire | 30/162 |
| 4,897,922 | 2/1990 | Brooker | 30/155 |
| 5,029,354 | 7/1991 | Boyd, Jr. et al. | 30/161 |

*Primary Examiner*—Frank T. Yost
*Assistant Examiner*—Hwei-Siu Payer
*Attorney, Agent, or Firm*—Marvin E. Jacobs

[57] ABSTRACT

A blade pivots on its tang into and out of a slot in a blade carrier. The carrier, in turn, slides in a handle between two positions. In the first position, the blade is prevented from pivoting out of the carrier by contact with the handle but in the second position the blade is free to rotate out of the slot to an extended configuration. The user slides the carrier between the two positions with a spring loaded button in the side of the handle.

13 Claims, 3 Drawing Sheets 9
9

FOLDING KNIFE

TECHNICAL FIELD

The present invention relates to the field of utility knives, especially knives with blades that fold and store in the handle for protection.

BACKGROUND OF THE INVENTION

Some prior art utility knives have blades that slide in and out of the handle by means of a thumb operated button on the side of the handle. Due to the limited distance the thumb can move, these blades move only a short distance, although one handed operation is possible.

Other prior art knives use folding blades that are generally longer than sliding blades since they pivot out of a slot in the handle. However, folding knives usually require two hands to operate since any mechanism that assists in the opening of the blade is ruled illegal in most states. One handed operation is desirable and convenient in a utility knife because the user's other hand is often fully engaged in supporting the workpiece, game, or other object to be cut.

The present invention provides a knife that is compact, lightweight, and operable with one hand while still being legal. In addition, this new and novel knife design is reliable, durable, and safe.

SUMMARY OF THE INVENTION

In brief, this invention contemplates a knife blade pivoted at its tang end on a slotted blade carrier which carrier is contained inside a handle. In the stored or folded position, the blade rests snugly inside the slot in the blade carrier. Extended, the blade swings out of the slot in the carrier to a position beyond the end of the carrier and generally in line therewith.

To control the swing of the blade in and out of the blade carrier, the combined blade and carrier are slidably mounted inside the handle of the knife. To open the knife, a spring loaded catch, which is accessible through a hole in the side of the handle, is pressed with the thumb. The catch leaves the hole allowing the catch and blade carrier to be slid by the users thumb a short distance out of the handle. The tang portion of the blade is now clear of the end of the handle thus allowing the blade to pivot out of the blade carrier, through a slot in the handle, to the extended position. The blade is firmly locked in the extended position by sliding the carrier and tang back into the handle and allowing the catch to snap back into the hole in the handle. As will be seen from the detailed description that follows, these movements are easily accomplished with one hand.

DETAILED DESCRIPTION OF THE INVENTION

Figure 1:
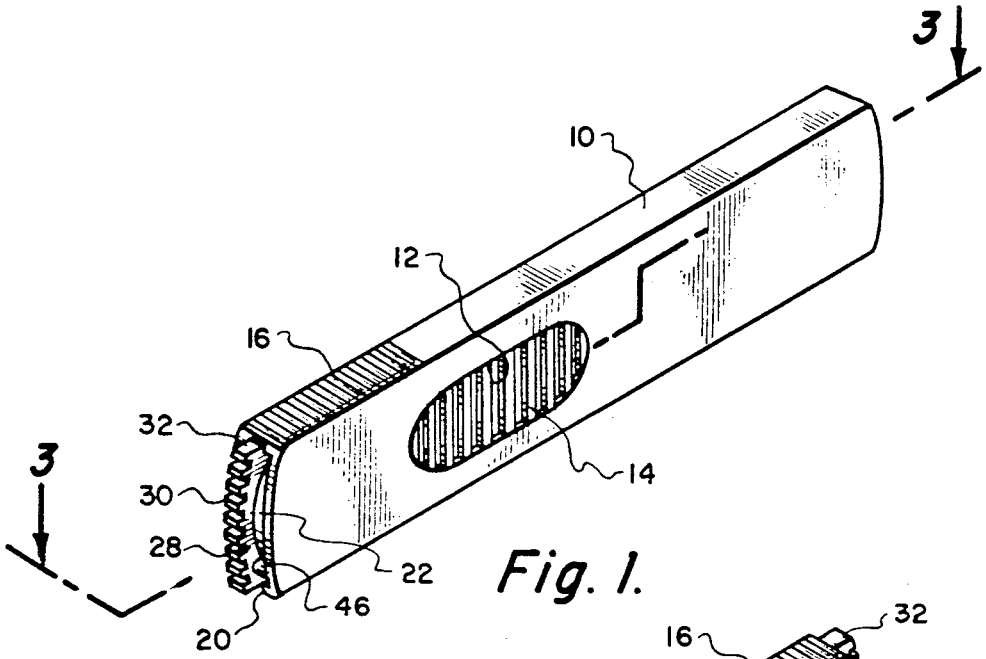
FIGS. 1 and 2 are perspective views of the knife from opposite sides with the blade folded inside the blade carrier and handle.
Figure 2:
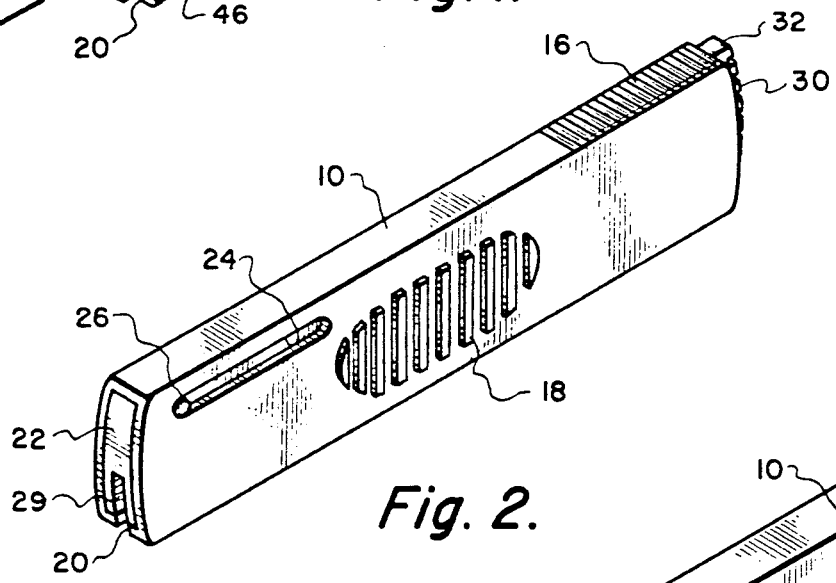

The knife of the present invention is shown in FIGS. 1 to 5 with the blade in the stored folded position. As best seen in FIGS. 1 and 2, a generally rectangular handle 10 has an oval hole 12 in the side within which rests an oval release catch 14. Catch 14 is ribbed on its surface to provide an enhanced gripping surface that is easily moved by the users thumb while holding the handle 10. Additional ribbing may be provided on top of the handle as shown at 16 and on the opposite side of the handle as at 18.

Handle 10 is hollow and also has a slot 20 that extends along its entire bottom edge. A blade carrier 22 slides inside hollow handle 10, left and right in FIG. 2, to the limits of a slot 24. A set screw 26, in carrier 22, comes to rest at the ends of slot 24, thus limiting the movement of carrier 22.

Blade carrier 22 is also slotted at its lower edge so as to receive a blade 28. This slot is numbered 29 in FIG. 2. The part of blade 28 that is visible in FIG. 1 has a series of friction enhancing ribs 30 that can easily be grasped by the thumb, while holding the handle in one hand, so as to rotate the blade to the extended position. However, the blade is prevented from rotating by a shoulder 32 on the blade that rests against the end of handle 10 adjacent to ribs 16. The blade is thereby locked in the stored position unless carrier 22 is first slid part way out of handle 10. This sliding is prevented by catch 14.

Figure 3:
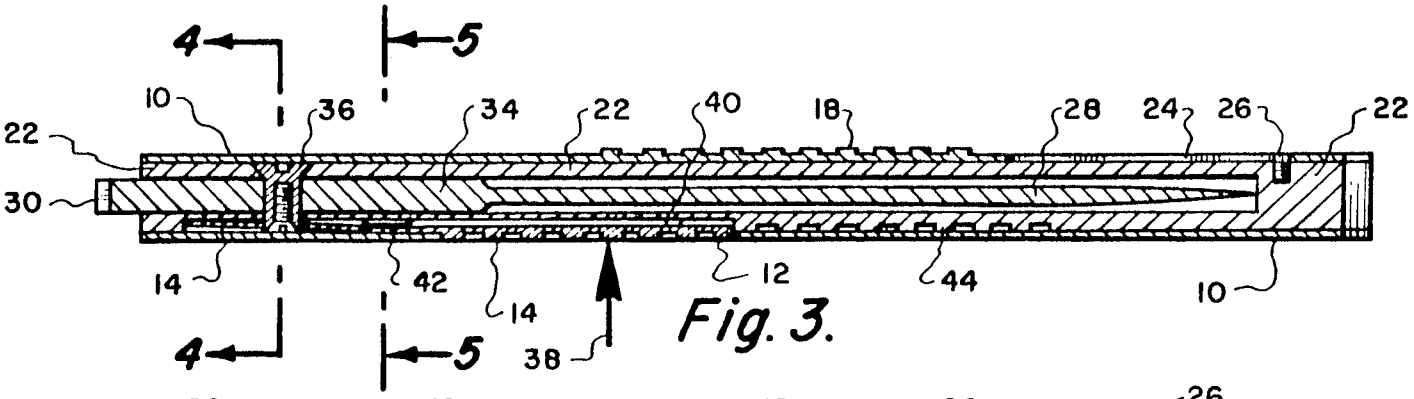
FIG. 3 is a horizontal section of the folded knife taken on line 3—3 in FIG. 1. Line 3—3 passes through the thumb operated catch so as to show clearly how the carrier is locked in place and released.

Turning to FIG. 3, it may be seen that blade 28 has a tang portion 34. The blade 28 pivots in carrier 22 about a pair of concentric cooperating screws 36 that pass through carrier 22 and tang 34. To open the knife, catch 14 is pressed inward as indicated by arrow 38 in FIG. 3. It may be seen that screws 36 also secure catch 14 against the bottom of a recess 40 in carrier 22. Catch 14 is springably urged outward into hole 12 by a small bent metal spring 42 that is most easily seen in FIG. 5. Thumb pressure moves catch 14 against spring 42 into recess 40 and then moves carrier 22 inside handle 10 to the position shown in FIG. 6.

Figure 6:
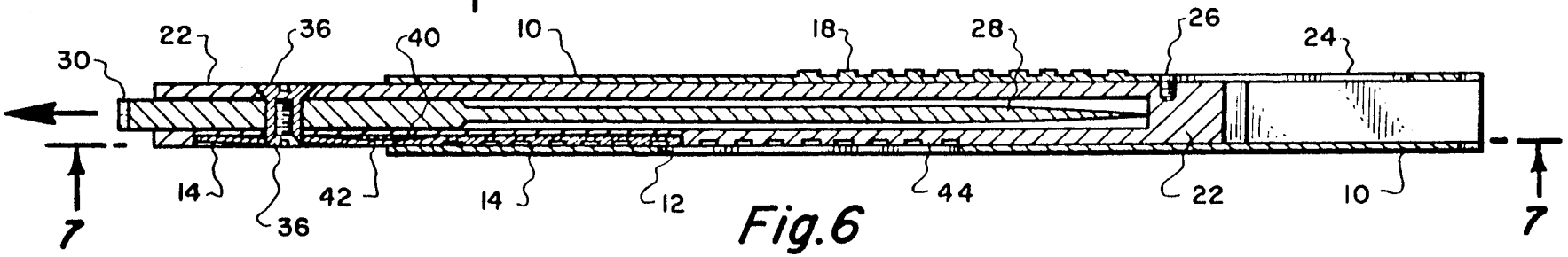
FIG. 6 is a horizontal section similar to FIG. 3 except that the blade and carrier are slid to the left to begin opening the blade.
Figure 7:
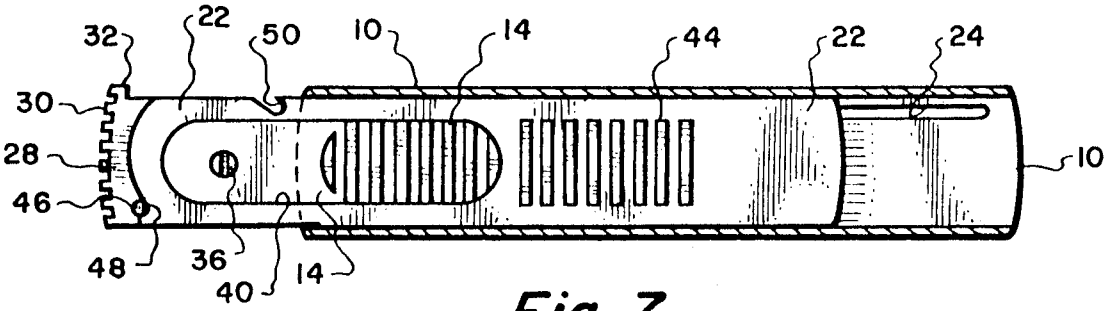
FIG. 7 is another view of the partly opened knife of FIG. 6, taken on line 7—7 in FIG. 6.
Figures 4, 5, 8, 9:
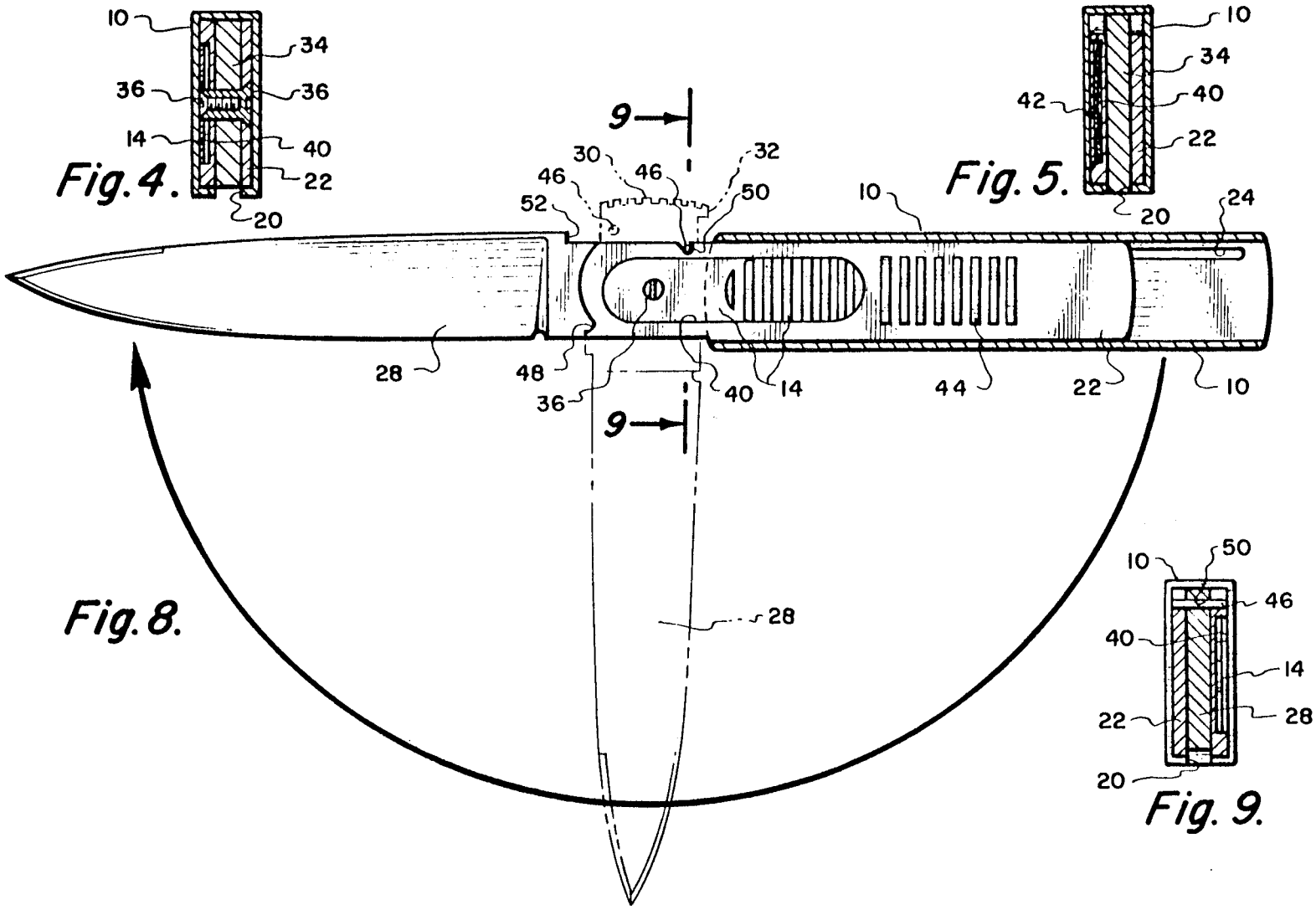
FIGS. 4 and 5 are cross-sectional views taken on lines 4—4 and 5—5 in FIG. 3 to better show the pivot screws upon which the blade swings and the spring clip that urges the thumb catch outward.
FIG. 8 is identical to FIG. 7 but showing the blade swinging to an extended position.
FIG. 9 is a cross-section of the extended blade and carrier taken on line 9—9 in FIG. 8.

In FIG. 6 it may be seen that when carrier 22 moves left inside handle 10, some additional ribbing 44 on carrier 22 slides into hole 12 to provide replacement for the ribbed catch 14 that is sliding beyond reach inside handle 10. Ribbing 44 helps the user to retract the carrier back into the handle. The configuration in FIG. 6 is also viewed from the side in FIG. 7. In FIG. 7, it may be seen that shoulder 32 is now away from the end of handle 10 so that blade 28 is free to rotate downward about the pivot axis established by screws 36. It should also be noted that blade 28 is prevented from upward rotation into the inside of handle 10 by a pin 46 on tang 34 that comes to rest on a stop 48 in carrier 22. When the blade rotates to the extended position, as best seen in FIG. 8, pin 46 engages another stop 50 in carrier 22. Thus, the blade is held in the extended position in alignment with handle 10 to facilitate sliding the carrier back into the handle. Once slid back, another shoulder 52 on blade 28 comes to rest against the end of handle 10. Also, pin 46 is trapped inside handle 10 so that the blade is held firmly in the extended position. Catch 14 springs outward into hole 12 again to keep the carrier retracted.

Figure 10:
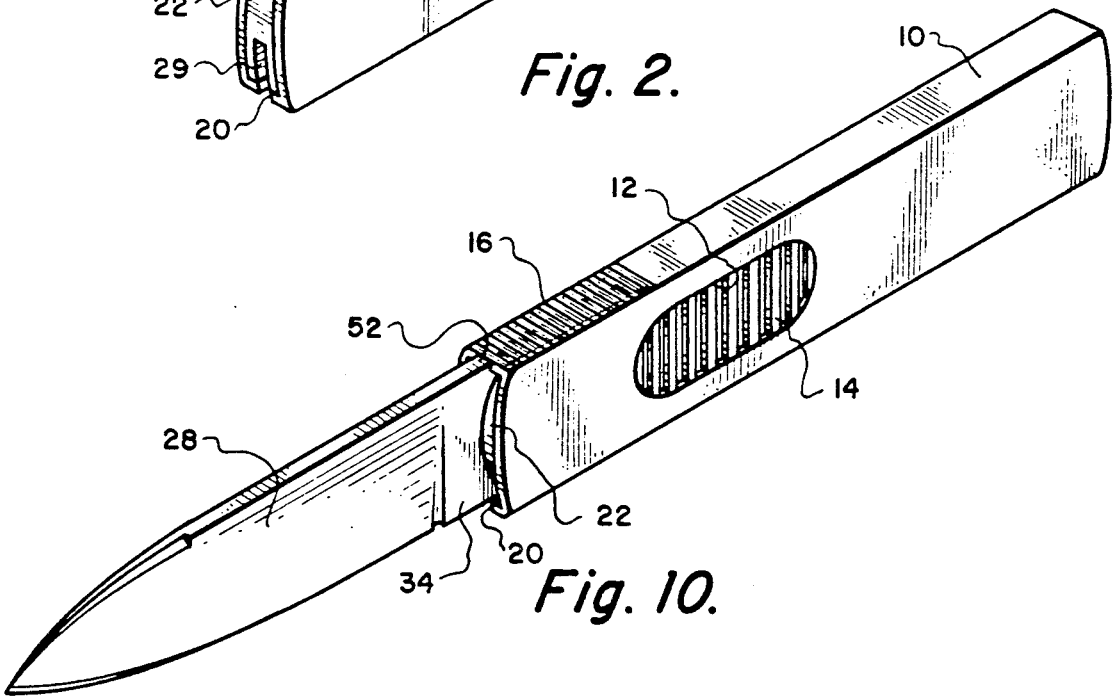
FIG. 10 is another perspective view of the knife, now with the blade extended and the blade carrier and tang slid back into the handle.

During rotation of the blade, one handed operation is facilitated by the ribs 30 on the end of tang 34 which are within easy reach of the users thumb. In the extended position, the knife appears as in the perspective view of FIG. 10. Blade 28 is anchored against further rotation by both shoulder 52 and the pin 46. Pin 46 is also visible in FIG. 9. Under heavy applied forces, the knife is still durable and safe as a consequence of these reliable locking mechanisms.

The compactness of this knife is apparent from the drawings. The thin design is easily carried in the pocket. The various parts may be formed from steel for strength. Alternatively, aluminum or titanium may be used for super light weight versions. Other variations may occur to those skilled in the art that remain within the spirit and scope of the invention and hence limitation in accordance only with the following claims is appropriate.

We claim:

1. A folding knife comprising in combination:

a blade having a tang portion and a cutting portion and a pivot axis in said tang portion;

a handle having a first slot therein said first slot being of a suitable length slightly greater than the distance from said pivot axis to the remote end of said cutting portion so as to allow the passage of said blade therethrough;

a blade carrier slidably disposed within said handle, said carrier having a second slot therein adapted to contain said blade, said second slot also being of said suitable length, said second slot being generally in alignment with the first slot in the handle, said blade tang portion adapted to pivot about said pivot axis in said carrier which axis is generally perpendicular to said second slot, the tang portion of said blade having shoulder means proximate one end of the handle so that said tang and blade are blocked from rotation about said axis by said shoulder means resting against said one end of the handle when said carrier is in a first location within said handle but free to rotate into an extended position when said carrier is in a second location; and catch means operable to retain said carrier in said first location and also operable to be released so said carrier can be moved to said second location.

2. The knife of claim 1 in which said catch means comprises a spring member mounted on said blade carrier and slidable therewith and adapted to spring outward against said handle in a position such that said spring member enters and engages a hole through said handle when said carrier is in said first location, said hole positioned to be convenient to be operated by thumb when holding the handle.

3. The knife of claim 2 including grip enhancing ribs on the end of said tang portion, on said spring member, and on said carrier at a location that comes into position under the hole in the handle.

4. The knife of claim 2 including a limit slot in said handle, said slot parallel to the direction of sliding of said carrier, and further including a guide pin means fastened to said carrier and disposed in said limit slot so as to limit the sliding of said carrier in said handle to said first and second locations and therebetween.

5. The knife of claim 2 including pin means protruding from said tang portion near the end remote from said cutting portion so as to be operable to pass around said carrier during rotation of said blade from a stored position in said second slot to said extended position, said pin means coming to rest against stop areas on said carrier at both the stored and extended positions of the blade so as to prevent further rotation of said blade.

6. The knife of claim 5 including grip enhancing ribs on the end of said tang portion, on said spring member, and on said carrier at a location that comes into position under the hole in the handle.

7. The knife of claim 6 including a limit slot in said handle and further including a guide pin means fastened to said carrier and disposed in said limit slot so as to limit the sliding of said carrier in said handle to said first and second locations and therebetween.

8. A folding knife comprising in combination:

a blade having a tang portion and a cutting portion;

a handle having a first slot therein;

a blade carrier slidably disposed within said handle, said carrier having a second slot therein adapted to contain said blade, said second slot being generally in alignment with the first slot in the handle, said blade tang portion adapted to pivot about a pivot axis in said carrier which axis is generally perpendicular to said second slot, said blade blocked from rotation about said axis when said carrier is in a first location within said handle but free to rotate into an extended position when said carrier is in a second location; and catch means operable to retain said carrier in said first location and also operable to be released so said carrier can be moved to said second location, said catch means comprising a spring member mounted on said blade carrier and slidable therewith and adapted to spring outward against said handle in a position such that said spring member enters and engages a hole through said handle when said carrier is in said first location, said hole positioned to be convenient to be operated by thumb when holding the handle.

9. The knife of claim 8 including grip enhancing ribs on the end of said tang portion, on said spring member, and on said carrier at a location that comes into position under the hole in the handle.

10. The knife of claim 6 including a limit slot in said handle and further including a guide pin means fastened to said carrier and disposed in said limit slot so as to limit the sliding of said carrier in said handle to said first and second locations and therebetween.

11. The knife of claim 8 including pin means protruding from said tang portion near the end of the tang portion remote from said cutting portion so as to be operable to pass around said carrier during rotation of said blade from a stored position in said second slot to said extended position, said pin means coming to rest against stop areas on said carrier at both the stored and extended positions of the blade so as to prevent further rotation of said blade.

12. The knife of claim 11 including grip enhancing ribs on the end of said tang portion, on said spring member, and on said carrier at a location that comes into position under the hole in the handle.

13. The knife of claim 12 including a limit slot in said handle and further including a guide pin means fastened to said carrier and disposed in said limit slot so as to limit the sliding of said carrier in said handle to said first and second locations and therebetween.

* * * * *